US009593512B2

(12) United States Patent
Rosales et al.

(10) Patent No.: US 9,593,512 B2
(45) Date of Patent: Mar. 14, 2017

(54) MOTOR VEHICLE DOOR LOCK ARRANGEMENT

(71) Applicant: BROSE SCHLIESSSYSTEME GMBH & CO. KG, Wuppertal (DE)

(72) Inventors: David Rosales, Rochester Hills, MI (US); Michael Wittelsbuerger, Lake Orion, MI (US); Stepan Hanke, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 14/815,590

(22) Filed: Jul. 31, 2015

(65) Prior Publication Data

US 2016/0097223 A1 Apr. 7, 2016

Related U.S. Application Data

(60) Provisional application No. 62/031,503, filed on Jul. 31, 2014.

(51) Int. Cl.
*E05B 15/00* (2006.01)
*E05B 77/12* (2014.01)
(Continued)

(52) U.S. Cl.
CPC ..... *E05B 77/12* (2013.01); *E05B 15/04* (2013.01); *E05B 77/06* (2013.01); *E05B 79/10* (2013.01); *E05B 79/20* (2013.01); *E05C 3/12* (2013.01)

(58) Field of Classification Search
CPC ..... E05B 15/04; E05B 77/02; E05B 77/04; E05B 77/06; E05B 77/12; E05B 79/10; E05B 79/20; E05B 79/22
(Continued)

(56) References Cited

U.S. PATENT DOCUMENTS 3,992,909 A 11/1976 Mcghee et al.
4,080,812 A * 3/1978 Knott ..... E05B 83/16 292/DIG. 43
(Continued)

FOREIGN PATENT DOCUMENTS

DE 4117110 12/1992
DE 19511651 10/1995
(Continued)

OTHER PUBLICATIONS

"Extended European Search Report," for European Patent Application No. 15179233 related to co-pending U.S. Appl. No. 14/815,590 mailed Dec. 22, 2015 (7 pages).
(Continued)

*Primary Examiner* — Janet M Wilkens

(74) *Attorney, Agent, or Firm* — Pauly, Devries Smith & Deffner, LLC

(57) ABSTRACT

The disclosure relates to a motor vehicle door lock arrangement with a motor vehicle lock, wherein a force transmission chain is provided and wherein an actuation movement may be transmitted via the force transmission chain for opening of the motor vehicle lock, which force transmission chain is designed for a longitudinal force transmission along a longitudinal extension of movement, wherein a crash coupling arrangement is provided between two force transmission chain sections, which comprises a coupling element in the form of a coupling spring element.

21 Claims, 6 Drawing Sheets

(51) Int. Cl.

| | |
|---|---|
| ***E05B 77/06*** | (2014.01) |
| ***E05B 79/10*** | (2014.01) |
| ***E05B 79/20*** | (2014.01) |
| ***E05B 15/04*** | (2006.01) |
| ***E05C 3/12*** | (2006.01) |

(58) Field of Classification Search
USPC ..... 292/92, 201, 216, 336.3, DIG. 22, 292/DIG. 23, DIG. 65
See application file for complete search history.

(56) References Cited

U.S. PATENT DOCUMENTS

| | | | | |
|---|---|---|---|---|
| 4,155,233 | A * | 5/1979 | Lira | E05B 15/004 292/111 |
| 4,441,236 | A * | 4/1984 | Bron | B60J 9/02 24/579.11 |
| 4,616,862 | A | 10/1986 | Ward et al. | |
| 5,865,481 | A | 2/1999 | Buschmann | |
| 6,042,159 | A * | 3/2000 | Spitzley | E05B 77/06 16/111.1 |
| 6,099,052 | A | 8/2000 | Spitzley et al. | |
| 6,464,270 | B1 | 10/2002 | Grahn et al. | |
| 7,597,368 | B2 | 10/2009 | Savant et al. | |
| 8,056,944 | B2 | 11/2011 | Jankowski et al. | |
| 8,152,209 | B2 * | 4/2012 | Lee | E05B 77/06 292/336.3 |
| 8,322,077 | B2 | 12/2012 | Papanikolaou et al. | |
| 8,414,038 | B2 * | 4/2013 | Bedekar | E05B 77/04 292/216 |
| 2003/0057698 | A1 * | 3/2003 | Parrott | F16L 37/23 285/1 |
| 2003/0080572 | A1 * | 5/2003 | So | E05B 83/24 292/336.3 |
| 2003/0234544 | A1 | 12/2003 | Jankowski et al. | |
| 2004/0251693 | A1 * | 12/2004 | Schoen | E05B 77/06 292/1 |
| 2007/0120382 | A1 * | 5/2007 | Chevalier | E05B 77/06 292/336.3 |
| 2009/0243307 | A1 | 10/2009 | Lee | |
| 2009/0309374 | A1 | 12/2009 | Lennhoff et al. | |
| 2009/0322105 | A1 | 12/2009 | Lee et al. | |
| 2010/0109350 | A1 * | 5/2010 | Gschweng | E05B 17/0062 292/196 |
| 2010/0207404 | A1 | 8/2010 | Corwin et al. | |
| 2011/0062747 | A1 * | 3/2011 | Teramoto | E05B 77/04 296/146.1 |
| 2011/0084505 | A1 | 4/2011 | Brose et al. | |
| 2011/0115252 | A1 * | 5/2011 | Higgins | E05B 77/04 296/146.1 |
| 2011/0181052 | A1 | 7/2011 | Brose et al. | |
| 2011/0258935 | A1 * | 10/2011 | Heller | B60J 5/0451 49/502 |
| 2011/0259061 | A1 | 10/2011 | Brose et al. | |
| 2013/0140831 | A1 * | 6/2013 | Kempel | E05B 83/26 292/3 |
| 2014/0284940 | A1 | 9/2014 | Rosales et al. | |
| 2014/0292005 | A1 | 10/2014 | Bendel et al. | |
| 2014/0312630 | A1 | 10/2014 | Bendel et al. | |
| 2015/0337566 | A1 * | 11/2015 | Wittelsbuerger | E05B 77/06 292/194 |

FOREIGN PATENT DOCUMENTS

| | | |
|---|---|---|
| DE | 10114965 | 10/2002 |
| DE | 202006011206 | 1/2008 |
| DE | 102008036356 | 12/2009 |
| DE | 202011002154 | 6/2012 |
| DE | 202012002175 | 8/2013 |
| EP | 0684357 | 11/1995 |
| EP | 1050640 | 11/2000 |
| EP | 1052355 | 11/2000 |
| EP | 2636826 | 9/2013 |
| EP | 2636827 | 9/2013 |
| FR | 2876135 | 4/2006 |
| GB | 1324131 | 7/1973 |
| GB | 2432184 | 5/2007 |
| WO | 2014019960 | * 2/2014 |

OTHER PUBLICATIONS

European Search Report for corresponding European Patent Application No. 10016238, mailed Sep. 17, 2015 (4 pages).
Final Office Action for U.S. Appl. No. 12/978,479 mailed Jan. 15, 2016 (18 pages).
German Search Report for German Patent Application No. 10 2015 108 203.9 (priority to U.S. Appl. No. 14/554,624) mailed May 24, 2016 (7 pages).
Non-Final Office Action for U.S. Appl. No. 12/978,479, mailed Jun. 30, 2015 (13 pages).
Non-Final Office Action for U.S. Appl. No. 12/978,479, mailed Mar. 28, 2014 (18 pages).
Non-Final Office Action for U.S. Appl. No. 14/554,624, mailed May 3, 2016 (16 pages).
Non-Final Office Action for U.S. Appl. No. 12/978,479, mailed on Dec. 16, 2014 (7 pages).

* cited by examiner

MOTOR VEHICLE DOOR LOCK ARRANGEMENT

CROSS-REFERENCES

This application claims the benefit of U.S. Provisional Application No. 62/031,503 filed Jul. 31, 2014, the content of which is hereby incorporated by reference in its entirety.

FIELD

This disclosure is generally directed to a motor vehicle lock, and more particularly directed to a motor vehicle door lock arrangement and to a crash coupling arrangement.

BACKGROUND

Crash safety plays an important role for today's motor vehicle locks. It is in particular important that neither crash induced acceleration nor crash induced deformation leads to an accidental and unintended opening of the motor vehicle door which the motor vehicle lock is assigned to. An aspect of the present application is to prevent an unintended opening of the motor vehicle door based on crash induced acceleration.

Because the outer door handle, which is connected to the motor vehicle lock via a force transmission chain, includes an inertial mass which is not rigidly connected to the vehicle door, the outer door handle does not immediately follow the movement of the motor vehicle door which is due to the acceleration stemming from the impact. As a result, a relative movement between the outer door handle and the motor vehicle door is caused, which may correspond to an opening movement of the outer door handle and thereby lead to an unintended opening of the motor vehicle lock and accordingly of the motor vehicle door.

The known motor vehicle lock (US 2011/0181052 A1), which is the starting point for the present invention, is provided with the usual lock elements catch and pawl, wherein the pawl may be deflected into a release position by actuation of a pawl actuation lever.

To guarantee a high crash safety the known motor vehicle lock includes a crash element, which is designed as a bendable wire. By the accelerations which occur during a crash, the crash element moves into a blocking position in which the crash element blocks further actuation of the pawl actuation lever.

One disadvantage of the known motor vehicle lock is the fact that, before the intended blocking of the pawl actuation lever takes place, the crash element has to perform the above noted movement into the blocking position. The necessity of the movement of the crash element before the intended blocking takes place leads to undesirable reaction times of the crash safety function.

Furthermore for the known motor vehicle lock, the constructional design of the force transmission chain between the door handle and the pawl appears to be challenging. This is true as in a crash situation not only the pawl actuation lever, but in fact the whole force transmission chain starting from the door handle to the pawl actuation lever it is being blocked. In order not to run the risk of an unpredictable breakage of some component in this force transmission chain, i.e. even some component other than the pawl actuation lever, it has to be designed for exceptionally high forces. This is especially true for the crash element, it being designed as a bendable wire.

SUMMARY

An aspect of the invention involves improving the known motor vehicle door lock arrangement such that a cost effective constructional design is possible without reducing the resulting crash safety.

In further detail the proposed motor vehicle door lock arrangement includes a force transmission chain, wherein an actuation movement, in particular an actuation movement initiated by manual operation of an outer door handle, may be transmitted via the force transmission chain for opening of the motor vehicle lock, which force transmission chain is designed for a longitudinal force transmission as is provided by a Bowden cable arrangement for example.

It is of particular importance for the invention that a crash coupling arrangement is provided between two force transmission chain sections of the force transmission chain, which crash coupling arrangement includes a coupling element in the form of a coupling spring element. Depending on the position of the coupling spring element the two force transmission chain sections are being coupled with each other or decoupled from each other respectively.

For this the coupling spring element can be brought into a coupling state, coupling the two force transmission chain sections, and into a decoupling state, decoupling the two force transmission chain sections.

For realizing the above noted coupling of the two force transmission chain sections the crash coupling arrangement includes a first link element assigned to one force transmission chain section and a second link element assigned to the other force transmission chain section. The link elements can be moveable along a longitudinal extension of movement, wherein the coupling spring element for coupling the two force transmission chain sections may come into coupling engagement with at least one of the link elements.

The inertial characteristic of the coupling spring element causes the coupling spring to fall into or to remain in the decoupling state, when the actuation movement surpasses a rapidity threshold. This means that an actuation movement of an outer door handle, which is induced by high crash accelerations, may run free without deflecting the pawl of the motor vehicle look. When the actuation movement is below the rapidity threshold, however, the coupling spring element falls into or remains in the coupling state, such that an actuation movement induced by normal operation of an outer door handle leads to a deflection of the pawl of the motor vehicle look, as far as the locking state of the motor vehicle lock allows such deflection of the pawl.

An interesting aspect of the present invention is the fact that the coupling spring element is not exposed to any extreme forces, even in a case of a crash. Based on this it has been concluded that the coupling spring element may be made of standard material like a spring metal. This is cost effective and easy to manufacture.

It may be pointed out that the link elements may well be realized as integral parts of the force transmission chain sections. In other words, the function of the link elements may fully be provided by the transmission chain sections. However, it may be suitable that those link elements are being designed separately from the respective force transmission chain sections.

One embodiment is directed to at least one of the link elements, in the area of interaction with the coupling spring, being at least partly symmetric with respect to the longitudinal extension of movement, such that this link element may be slidingly rotated against the rest of the crash coupling arrangement around the longitudinal extension of movement without affecting its interaction with the coupling spring. With this it is possible to have a rotational movement of the two force transmission chain sections against each other around the longitudinal extension of movement without affecting the function of the coupling arrangement. This is especially interesting if the force transmission chain sections comprise a Bowden arrangement that generally tends to perform such movements around the longitudinal extension of movement in the course of the lifetime of the motor vehicle door lock arrangement. This is also subject of an independent teaching, as will be explained later.

In some cases, the spring bias of the reset spring is such that the reset spring may overrule the spring bias of the coupling spring element such that, when in the non-actuated state, the reset spring safely holds the coupling spring element in its freewheeling position. Only when an actuation movement occurs, for example by pulling an outer door handle, the first link element releases the coupling spring element such that the coupling spring element moves, driven by its own spring bias, into the catch position. Depending on the rapidity of the actuation movement the coupling spring element reaches its decoupling state or its coupling state.

It is of particular importance here that when the actuation movement surpasses the rapidity threshold there is no movement of the coupling spring element necessary to achieve that the coupling spring element is in its decoupling state. This is why the proposed solution provides an exceptionally high operational safety in a crash situation.

A cost effective approach can involve the coupling spring element being at least partly or fully made of an elastically bendable wire or strip. In particular the coupling spring element may be at least partly or fully made of a spring cable, which may be produced with extremely low costs.

It has proven to be robust on the one hand and cost effective on the other hand if, the coupling spring element is a leg spring with two legs. This is especially true as the spring coil between the two legs of the leg spring may well provide the actuation section of the coupling spring element.

In some cases the coupling spring element is used to decouple the force transmission chain sections, which decoupling may be initiated by a crash induced deformation of a part of the motor vehicle. In particular it may be advantageous that the deformed part of the motor vehicle comes into engagement with an impact section of the coupling spring element, urging the coupling spring element into its freewheel position. Accordingly the coupling spring element provides not only a rapidity dependent decoupling, but also a deformation dependent decoupling of the force transmission chain sections. This double use of the coupling spring element leads to a compact and cost effective solution.

Generally at least one section of the force transmission chain may be part of the motor vehicle lock. For example, depending on the overall structure of the motor vehicle door lock arrangement, it may be favorable to realize the crash coupling arrangement as an integral part of the motor vehicle lock, while one section of the force transmission chain is provided separately from the motor vehicle lock. In this case the separate force transmission chain section is realized as a Bowden arrangement.

Generally it is also possible that the complete force transmission chain as well as the crash coupling arrangement with the coupling spring is realized as integral parts of the motor vehicle.

It may be advantageous that the motor vehicle door lock arrangement includes a door handle, wherein at least one section of the force transmission chain is part of the door handle. In this case, the crash coupling arrangement is part of the door handle.

Instead of being an integral part of the motor vehicle lock or the door handle, in the above noted cases, the crash coupling arrangement may be attached to the motor vehicle lock respective the door handle.

In some cases the crash coupling arrangement is provided separately from the motor vehicle lock, which makes it easily possible to provide two product alternatives, one including the crash coupling arrangement and one excluding the crash coupling arrangement. In some cases at least one force transmission chain section includes an above noted Bowden arrangement with a Bowden cable and a Bowden sheath surrounding the Bowden cable.

Another teaching of the invention, in addition to the teaching above, is directed to the crash coupling arrangement as such, which can be realized separately from the motor vehicle lock. This aspect focuses on the coupling element being realized as a coupling spring. All explanations given to the above first teaching are fully applicable to this second teaching.

Another teaching, which is of independent importance as well, is also directed to the crash coupling arrangement as such, which again can be realized separately from the motor vehicle lock. This third teaching is directed to at least one of the link elements, in the area of interaction with the coupling element, being at least partly symmetric with respect to the longitudinal extension of movement, such that this link element may be slidingly rotated against the rest of the crash coupling arrangement around the longitudinal extension of movement without affecting its interaction with the coupling spring. It has been explained already that this feature is advantageous in particular with at least one force transmission chain section being designed as a Bowden arrangement. All explanations given to the first two teachings are fully applicable to this third teaching.

According to an embodiment, a motor vehicle door lock arrangement is provided with a motor vehicle lock, wherein a force transmission chain is provided and wherein an actuation movement may be transmitted via the force transmission chain for opening of the motor vehicle lock. A crash coupling arrangement is provided between two force transmission chain sections, which includes a coupling element in the form of a coupling spring element. The coupling spring element can be brought into a coupling state, coupling the two force transmission chain sections, and into a decoupling state, decoupling the two force transmission chain sections. The crash coupling arrangement includes a first link element assigned to one force transmission chain section and a second link element assigned to the other force transmission chain section. The link elements are optionally moveable along a longitudinal extension of movement. The coupling spring element for coupling the two force transmission chain sections may come into coupling engagement with at least one of the link elements. An inertial characteristic of the coupling spring element causes the coupling spring element to fall into or to remain in the decoupling state, when the actuation movement surpasses a rapidity threshold. The inertial characteristic causes the coupling spring element to fall into or to remain in the coupling state, when the actuation movement is below the rapidity threshold.

In some cases the motor vehicle lock includes a catch and a pawl, which is assigned to the catch. The catch can be brought into an opening position and into a closed position. The catch, which is in the closed position, is or may be brought into holding engagement with a lock striker. The pawl may be brought into an engagement position, in which it is in blocking engagement with the catch. To open the motor vehicle lock, the pawl may be deflected into a release position, in which it releases the catch.

In some cases at least one of the link elements, in the area of interaction with the coupling spring element, is at least partly symmetric with respect to the longitudinal extension of movement. In this configuration, rotation of this link element against the rest of the crash coupling arrangement around the longitudinal extension of movement does not affect its interaction with the coupling spring element.

Optionally, the coupling spring element may be brought into a catch position, in which the coupling spring element is arranged within the movement area of the first link element. The coupling spring element may be brought into a freewheel position, in which the coupling spring element is arranged outside the movement area of the first link element.

According to some examples, the coupling spring element includes a first output section and a second output section. The spring bias of the coupling spring element acts between the first output section and the second output section. The first output section of the coupling spring element includes an engagement section for the coupling engagement with an engagement section of the first link element.

In some cases the second output section is connected to the second link element, such that a coupling engagement between the first output section and the first link element leads to coupling of the two link elements. The coupling of the two link elements further leads to coupling of the two force transmission chain sections.

In some cases, the spring bias of the coupling spring element urges the coupling spring element into its catch position.

According to some implementations, the first link element is spring biased by a reset spring. The reset spring, in the non-actuated state, drives an actuation section of the first link element into engagement with an actuation section of the coupling spring element, thereby driving the coupling spring element into its freewheel position against the spring bias of the coupling spring element.

In some cases, during actuation, the engagement section of the first link element moves along the longitudinal extension of movement and the actuation section of the first link element releases the actuation section of the coupling spring element, such that the coupling spring element moves, driven by its spring bias, into the catch position. Further examples provide that when the actuation movement surpasses the rapidity threshold during actuation due to the inertial characteristic of the coupling spring element, the engagement section of the first link element bypasses the engagement section of the coupling spring element, before the coupling spring element reaches its catch position, such that the coupling spring element enters its decoupling state. Further, when the actuation movement is below the rapidity threshold during actuation, the engagement section of the coupling spring element reaches its catch position before the engagement section of the first link element bypasses the engagement section of the coupling spring element, such that the coupling spring element enters its coupling state.

In some implementations a part of the coupling spring element, such as the first output section of the coupling spring element, is guided in a guide contour. The reset spring, in the non-actuated state, drives the part of the coupling spring element along the guide contour. In addition, the guide contour may be slanted with respect to the longitudinal extension of movement such that, in the non-actuated state, driving the coupling spring element along the guide contour by the spring bias of the reset spring leads to driving the coupling spring element into its freewheel position.

In some cases the coupling spring element is at least partly or fully made of an elastically bendable wire or strip. In some cases the coupling spring element is at least partly made of spring steel. The coupling spring element is optionally a leg spring with two legs. One leg provides the first output section and the other leg provides the second output section. In some cases the coupling spring element includes a spring coil between the two legs. Further, the spring coil can provide the actuation section of the coupling spring element.

In some implementations of the invention, the first link element includes the actuation section and the engagement section connected to it. Optionally, the actuation section and/or the engagement section is/are rotationally symmetrical with respect to the longitudinal extension of movement. Further, the second link element can optionally be a tube-like element, which receives at least part of the first link element. For example, the second link element may receive at least part of the engagement section of the first link element.

In some cases the coupling spring element includes an impact section. In the installed state, the impact section may be driven by a deformed part due to a crash-induced deformation of a part of the motor vehicle. For example, the part may be a body part of the motor vehicle. The driving of the impact section drives the coupling spring element into its freewheel position.

Sometimes the crash coupling arrangement is provided separately from the motor vehicle lock. Alternatively, or additionally, at least one force transmission chain section may be provided separately from the motor vehicle lock. In some cases at least one force transmission chain section includes a Bowden arrangement with a Bowden cable and a Bowden sheath.

According to another aspect, a crash coupling arrangement is provided for the insertion between two sections of a force transmission chain for a motor vehicle lock. In the installed state, an actuation movement may be transmitted via the force transmission chain for opening of the motor vehicle lock. The crash coupling arrangement includes a coupling element in the form of a coupling spring element. The crash coupling arrangement includes a first link element assigned to one force transmission chain section and a second link element assigned to the other force transmission chain section. In some cases the link elements are moveable along a longitudinal extension of movement. The coupling spring element for coupling the two force transmission chain sections may come into coupling engagement with at least one of the link elements. An inertial characteristic of the coupling spring element causes the coupling spring element to fall into or to remain in the decoupling state, when the actuation movement surpasses a rapidity threshold. The inertial characteristic causes the coupling spring element to fall into or to remain in the coupling state, when the actuation movement is below the rapidity threshold.

According to another aspect, a crash coupling arrangement for the insertion between two sections of a force transmission chain for a motor vehicle lock is provided. In the installed state, an actuation movement may be transmitted via the force transmission chain for opening of the motor vehicle lock. The crash coupling arrangement includes a coupling element, a first link element assigned to one force transmission chain section and a second link element assigned to the other force transmission chain section. The link elements are moveable along a longitudinal extension of movement, and the coupling element for coupling the two force transmission chain sections may come into coupling engagement with at least one of the link elements. An inertial characteristic of the coupling element causes the coupling element to fall into or to remain in the decoupling state, when the actuation movement surpasses a rapidity threshold, and causes the coupling element to fall into or to remain in the coupling state, when the actuation movement is below the rapidity threshold. At least one of the link elements, in the area of interaction with the coupling element, is at least partly symmetric with respect to the longitudinal extension of movement, such that rotation of this link element against the rest of the crash coupling arrangement around the longitudinal extension of movement does not affect its interaction with the coupling spring element.

BRIEF DESCRIPTION OF THE DRAWINGS

In the following, the invention will be described in an example referring to the drawings. The drawings illustrate some particular embodiments and/or features of the present invention and therefore do not limit the scope of the invention. The drawings are not to scale (unless so stated) and are intended for use in conjunction with the explanations in the following detailed description. Some embodiments will hereinafter be described in conjunction with the appended drawings, wherein like numerals denote like elements. In the drawings there is shown in FIG. 1 a motor vehicle door lock arrangement in the installed state, FIG. 2*a*) the motor vehicle lock of the motor vehicle door lock arrangement shown in FIG. 1 and *b*) the crash coupling arrangement of the motor vehicle door lock arrangement shown in FIG. 1, each in a partly demounted state, FIG. 3 the crash coupling arrangement shown in FIG. 2*b*) in the non-actuated state in top view, FIG. 4 the crash coupling arrangement shown in FIG. 2*b*) during normal operation in top view a) during the inertia movement section and b) during the driving movement section, FIG. 5 the crash coupling arrangement shown in FIG. 2*b*) in a crash situation in top view a) during the inertia movement section and b) during the driving movement section and FIG. 6 a second embodiment of the crash coupling arrangement shown in FIG. 2*b*) in detail top view in the non-actuated state a) without crash deformation and b) with crash deformation.

DETAILED DESCRIPTION

The following detailed description is exemplary in nature and is not intended to limit the scope, applicability, or configuration of the invention in any way. Rather, the following description provides some practical illustrations for implementing some embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

The motor vehicle door lock arrangement described herein at least includes a motor vehicle lock, which is assigned to a motor vehicle door arrangement. The motor vehicle door arrangement includes at least a motor vehicle door. The expression "door" is to be understood in a broad sense. It includes, in particular, side doors, back doors, lift gates, trunk lids or engine hoods. Such a motor vehicle door can generally be designed as a sliding door as well.

An important recognition underlying the present invention is that it is better to have a component freewheel in the case of a crash rather than to block a moving component in the case of a crash. This is because, as was already pointed out, in the case of a crash the door handle may experience a very fast relative movement to the vehicle door, thereby causing a very high velocity of the moving component which again may cause that moving component or some other part involved to break when it is being blocked. If, on the other hand, the moving component is freewheeling in case of a crash, there is no impact associated with the crash. This concept is called "freewheeling crash concept" in the following.

A distinction between the crash situation and a normal operation situation of the door handle may then be made based on the level of acceleration or speed with which the door handle is moved. Very high velocity or acceleration is indicative of a crash state. Therefore, according to the invention, the inertial properties of the motor vehicle door lock arrangement may be exploited, such that in cases of high acceleration or velocity a freewheeling movement of the door handle is performed, whereas in the cases of lower acceleration or velocity deflection of the pawl by the door handle is possible.

Turning now to the Figures, a motor vehicle door arrangement 1 includes a motor vehicle lock 2. It may also comprise, as shown in FIG. 1, a door handle 3, which in this case is an outer door handle.

Figure 1:
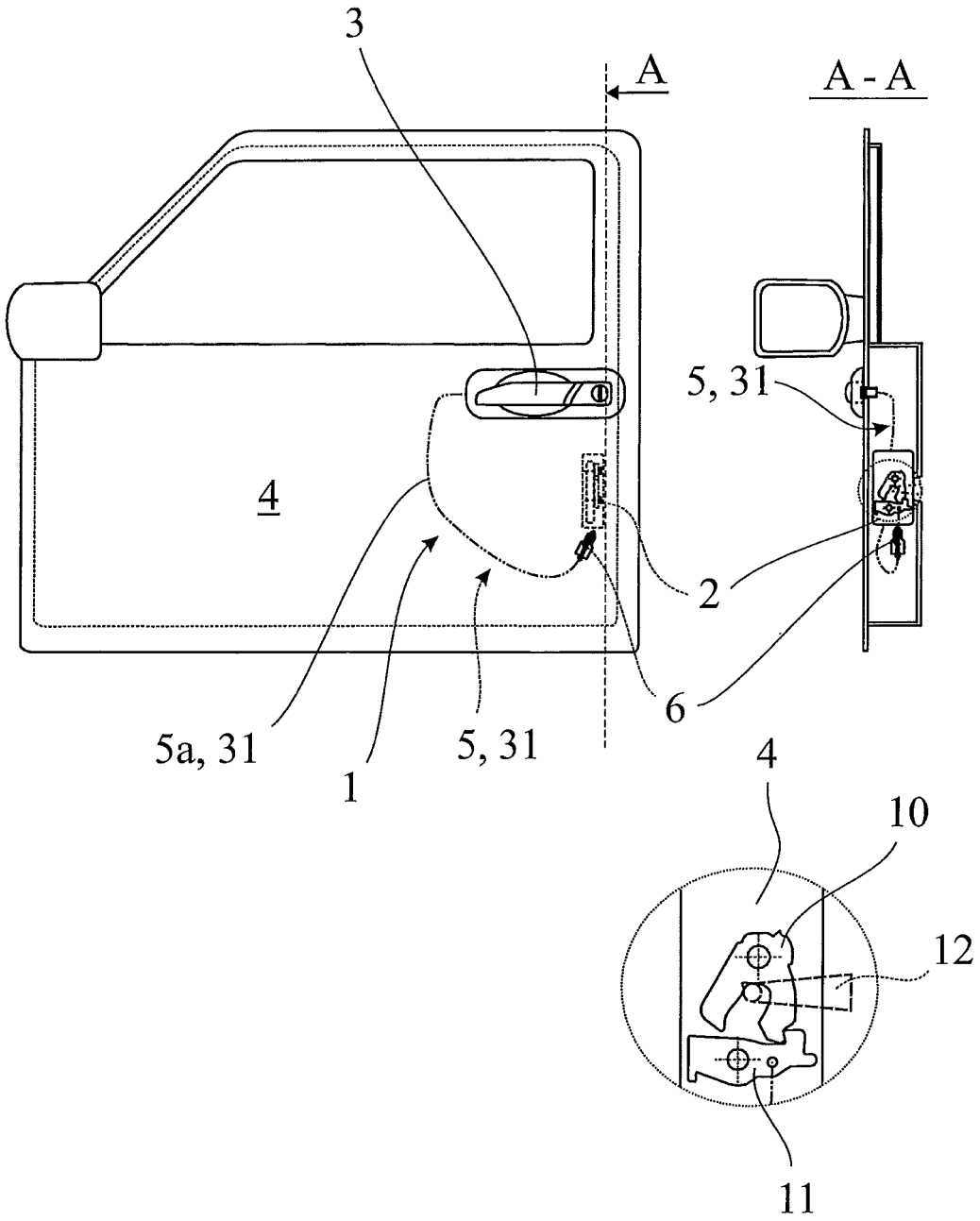

The motor vehicle lock 2 shown in the drawings is assigned to a motor vehicle door arrangement 1 which includes the motor vehicle door 4 as also shown in FIG. 1. Regarding the broad interpretation of the expression "door" reference is made to the introductory part of the specification. Here the motor vehicle door 4 is a side door of the motor vehicle.

FIG. 1 shows that a force transmission chain 5 is provided, wherein an actuation movement induced by a manual operation of the door handle 3, may be transmitted via the force transmission chain 5 to the motor vehicle lock 2 in order to open the motor vehicle lock 2.

The motor vehicle lock 2 includes a lock mechanism (not shown) which allows to bring the motor vehicle lock 2 into different locking states like "unlocked" or "locked". In the locking state "unlocked" an actuation movement induced by the door handle 3 leads to opening of the motor vehicle lock 2. In the locking state "locked", the actuation movement runs free.

The force transmission chain 5 includes at least two force transmission chain sections 5*a*, 5*b*, wherein one force transmission chain section 5*a* is at least partly realized as a Bowden arrangement and wherein the other force transmission chain section 5*b* is part of the motor vehicle lock 2. Other mechanical structures of the force transmission chain 5 are possible, as will be explained later.

In order to prevent an unintended opening of the motor vehicle lock 2 and in the end an unintended opening of the motor vehicle door 4 during a crash situation, a crash coupling arrangement 6 is provided between the two force transmission chain sections 5*a*, 5*b*. The general idea underlying the crash coupling arrangement 6 is to uncouple the two force transmission chain sections 5*a*, 5*b* in the case that high crash accelerations lead to an actuation movement with high rapidity. For this the crash coupling arrangement 6 includes a coupling element in the form of a coupling spring element 7.

The coupling spring element 7 can be brought into a coupling state, coupling the two force transmission chain sections 5*a*, 5*b* to each other (FIG. 4*b*)). The coupling spring element 7 can also be brought into a decoupling state, decoupling the two force transmission chain sections 5*a*, 5*b* (FIG. 5) from each other.

Figure 3:
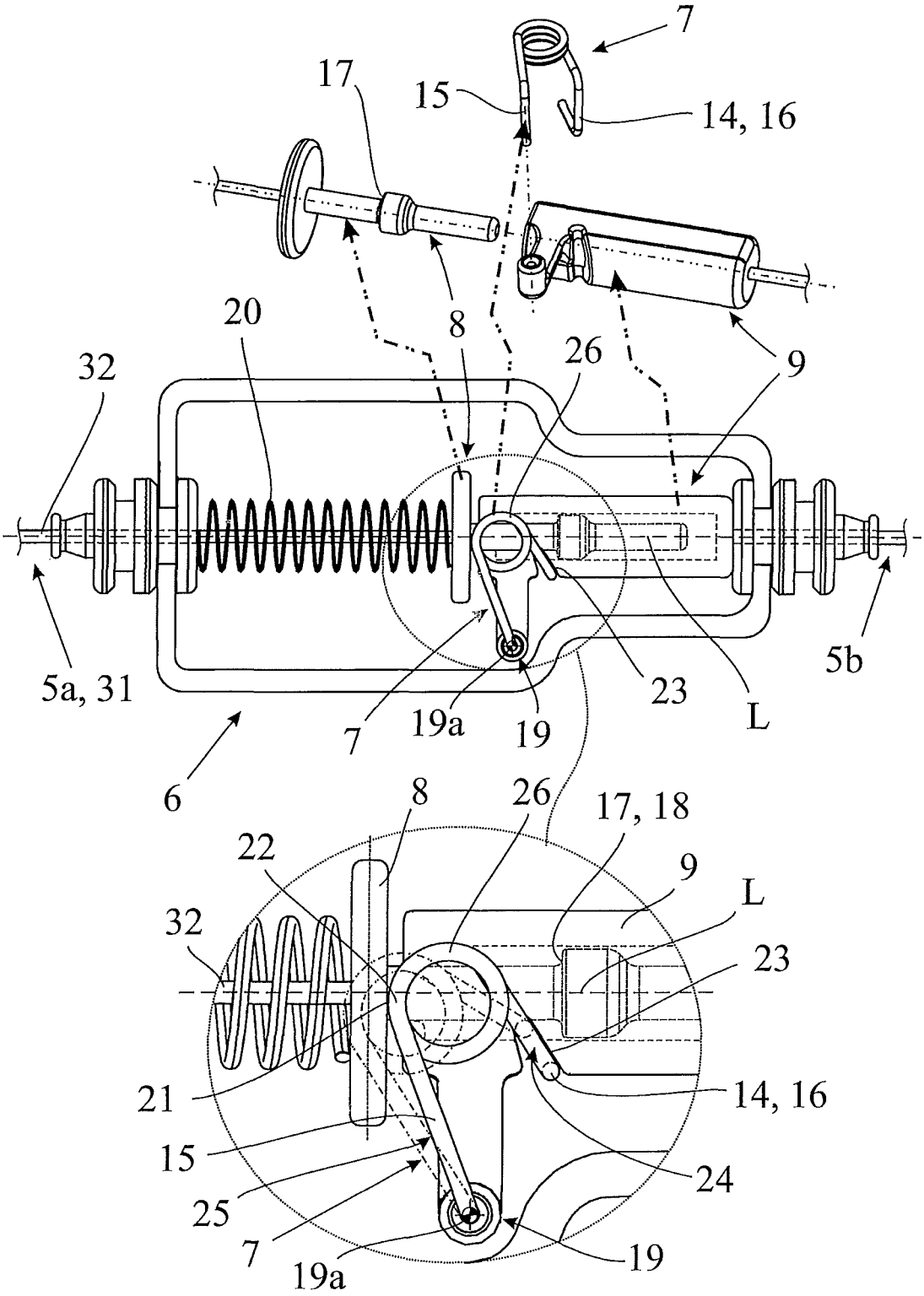

FIG. 3 shows that the crash coupling arrangement 6 includes a first link element 8 assigned to one force transmission chain section 5*a* and a second link element 9 assigned to the other force transmission chain section 5*b*. The link elements 8, 9 are moveable along a longitudinal extension of movement L.

The coupling spring element 7 may come into coupling engagement with at least one of the link elements 8, 9. For example, the coupling spring element 7 may come into coupling engagement with the first link element 8, for coupling the two force transmission chain sections 5*a*, 5*b* to each other.

The above noted freewheeling crash concept is now based on the idea that an inertial characteristic of the coupling spring element 7 causes the coupling spring element 7 to fall into or to remain in the decoupling state, when the actuation movement surpasses a rapidity threshold (FIG. 5*b*)) and causes the coupling spring element 7 to fall into or to remain in the coupling state, when the actuation movement is below the rapidity threshold (FIG. 4*b*)).

As noted above, the link elements 8, 9 may generally be an integral part of the force transmission chain sections 5*a*, 5*b*. In this example, however, the link elements 8, 9 are designed separately from the force transmission chain sections 5*a*, 5*b*.

Figure 2:
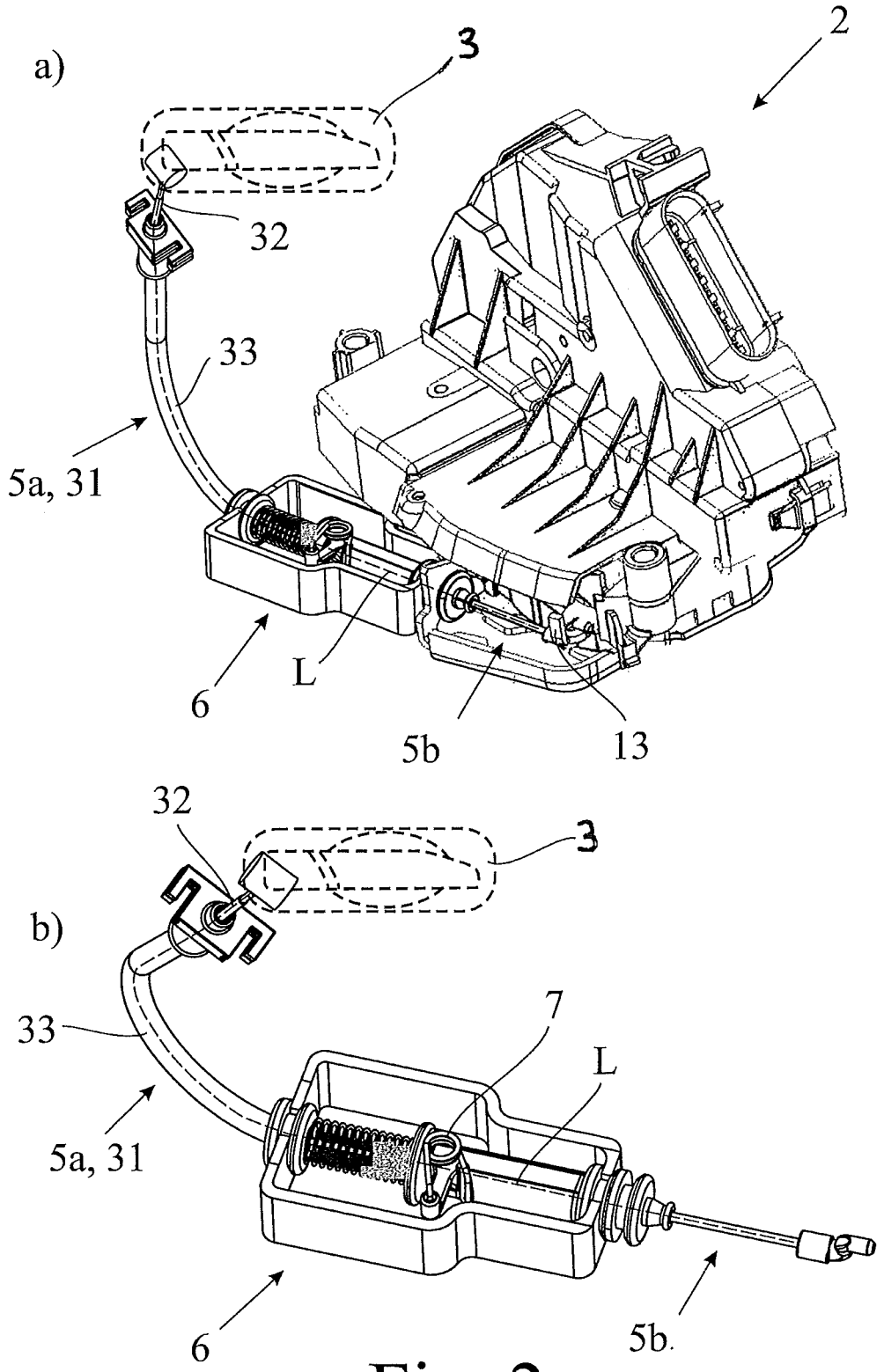

The present invention may be applied to motor vehicle locks 2 of different structure. The motor vehicle lock 2 includes a catch 10 and a pawl 11, which is assigned to the catch 10. The catch 10 can be brought into an opening position (not shown) and into a closed position (FIG. 1), wherein the catch, which is in the closed position, is in holding engagement with a lock striker 12, which is shown in dotted lines in FIG. 1. The pawl 11 may be brought into an engagement position (FIG. 1), in which it is in blocking engagement with the catch 10. For opening of the motor vehicle lock 2 the pawl 11 may be deflected into a release position, in which it releases the catch 10. In the detail view of FIG. 1 such deflection of the pawl 11 for opening of the motor vehicle lock 2 would be a pivot movement of the pawl 11 in a clockwise direction. The motor vehicle lock 2 includes an actuation lever 13, which actuation leads to deflecting the pawl 11 for opening of the motor vehicle lock 2, if the locking mechanism of the motor vehicle lock 2 is in the respective locking state. FIG. 2 shows that one force transmission chain section 5*b* is connected to the actuation lever 13 of the motor vehicle lock 2.

FIG. 3 shows that one of the link elements 8, 9, for example, the first link element 8, in the area of interaction with the coupling spring element 7, is at least partly symmetric with respect to the longitudinal extension of movement L, such that this link element 8 may be slidingly rotated against the rest of the crash coupling arrangement 6 around the longitudinal extension of movement L without affecting its interaction with the coupling spring element 7. In an embodiment at least the respective part of the first link element 8 is rotationally symmetric, as also shown in FIG. 3. The same may be applied to the second link element 9.

Looking at FIG. 2*a*, the symmetric design of the first link element 8 as noted above is especially advantageous as during normal operation at least a slight rotational movement of the force transmission chain section 5*a* is to be expected, which would lead to undesired forces for example between the first link element 8 and the coupling spring element 7. With the above noted symmetric design and also the possibility of the first link element 8 being able to rotationally slide by the coupling spring element 7, the above noted undesired forces may be avoided with little constructional effort. This in general is subject of an independent teaching, as will be explained later.

The coupling spring element 7 may be brought into a catch position, in which the spring element 7 is in the movement area of the first link element 8. This is shown in FIGS. 4*a*), 4*b*) and 5*b*). The coupling spring element 7 arranged within the movement area of the first link element 8 is a necessary precondition for the coupling spring element 7 coming into coupling arrangement with the first link element 8 as will be explained later. The coupling spring element 7 may also be brought into a freewheel position, in which the coupling spring element 7 is arranged outside the movement area of the first link element 8. This is shown in FIG. 3. The arrangement of the coupling spring element 7 outside the movement area of the first link element 8 does not allow a coupling engagement of the coupling spring element 7 with the first link element 8. The partly exploded view in FIG. 3 shows that the coupling spring element 7 includes a first output section 14 and a second output section 15, wherein the spring bias of the coupling spring element 7 acts between the first output section 14 and the second output section 15. It is of particular importance here, that the first output section 14 of the coupling spring element 7 includes an engagement section 16 for the coupling engagement with an engagement section 17 of the first link element 8. Interesting here is the fact that the engagement section 16 of the coupling spring element 7 is provided by a spring wire section of the coupling spring element 7 leading to an especially cost effective solution. The engagement section 17 of the first link element 8 is realized as a simple abutment 18 arranged at the first link element 8. The abutment 18 is of ring-like design which is aligned coaxially with respect to the longitudinal extension of movement L.

The second output section 15 of the coupling spring element 7 is connected to the second link element (FIG. 3), such that a coupling engagement between the first output section 14 of the coupling spring element 7 and the first link element 8 leads to coupling of the two link elements 8, 9 and thereby coupling of the two force transmission chain sections 5*a*, 5*b*, as is shown in FIG. 4*b*). The connection of the second output section 15 to the second link element 9 is realized by a pivot bearing 19, allowing the coupling spring element 7 to pivot around a pivot axis 19*a* as shown in FIG. 3.

The spring bias of the coupling spring element 7 plays an important role for the function of the crash coupling arrangement 6. The spring bias of the coupling spring element 7 urges the coupling spring element 7 into its catch position. For the embodiment shown in FIGS. 3 to 5 this means that the spring bias acts onto the first output section 14 of the coupling spring element 7 towards the first link element 8. In the drawings, this spring bias acts in an upwards direction.

While the spring bias of the coupling spring element 7 urges the coupling spring element 7 into its catch position, a reset spring 20 is provided, that counteracts the spring bias of the coupling spring element 7. In detail, the first link element 8 is spring biased by such reset spring 20, which reset spring 20, in the non-actuated state of the force transmission chain 5, drives an actuation section 21 of the first link element 8 into engagement with an actuation section 22 of the coupling spring element 7 thereby driving the coupling spring element 7 into its freewheel position against the spring bias of the coupling spring element 7. This means that as long as the force transmission chain 5 is in its non-actuated state the spring bias of the reset spring 20 overrules the spring bias of the coupling spring element 7 such that the coupling spring element 7 remains in its freewheel position as shown in FIG. 3.

The detail view in FIG. 3 shows that the reset spring 20 acts along the longitudinal extension of movement L onto the actuation section 22 of the coupling spring element 7, driving the second output section 15 of the coupling spring element 7 in FIG. 3 downwards with the support of guiding means to be explained later. Here it becomes clear, that in the non-actuated state of the force transmission chain 5, which is displayed in FIG. 3, the coupling spring element 7 is always forced into its freewheel position by the reset spring 20.

Interesting is now the situation during actuation, in particular during actuation of the force transmission chain section 5*a* by operating the outer door handle 3. In some cases the actuation movement includes an inertia movement section, which is followed by driving movement section, wherein during the inertia movement section the inertial characteristic of the coupling spring element 7 causes the coupling spring element 7 entering the coupling state or the decoupling state depending on the rapidity of the actuation movement. This may be apparent from a comparison of FIG. 3 (normal actuation) and FIG. 4 (crash induced actuation).

During the inertia movement section, the actuation movement runs free, as there is no coupling engagement between the coupling spring element 7 and the engagement section 17 of the first link element 8. The inertia movement section in the shown embodiments corresponds to the sequence of FIGS. 3 and 4*a*). The driving movement section corresponds to the sequence of FIGS. 4*a*) and 4*b*) as well as the sequence of FIGS. 5*a*) and 5*b*).

Figure 4:
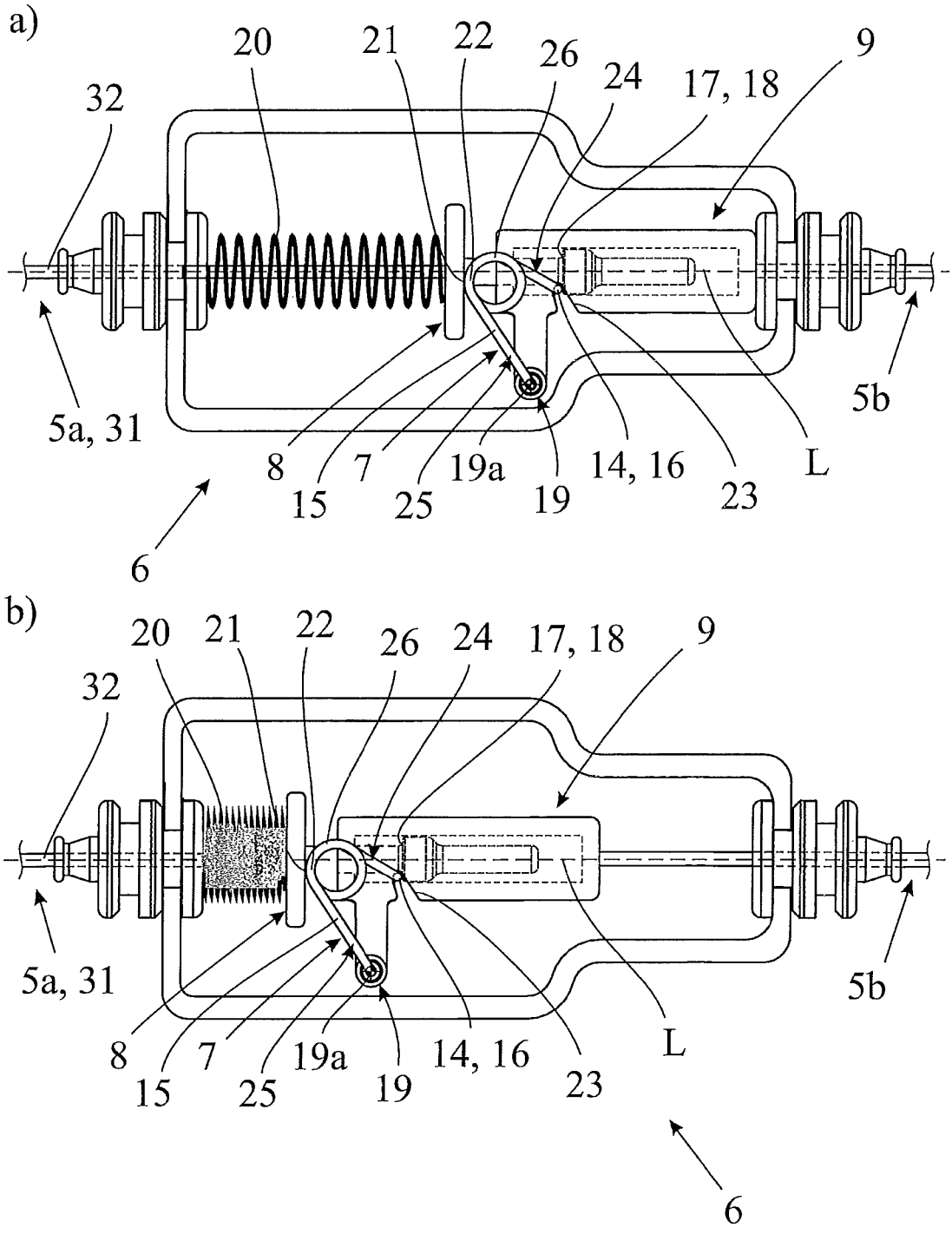
Figure 5:
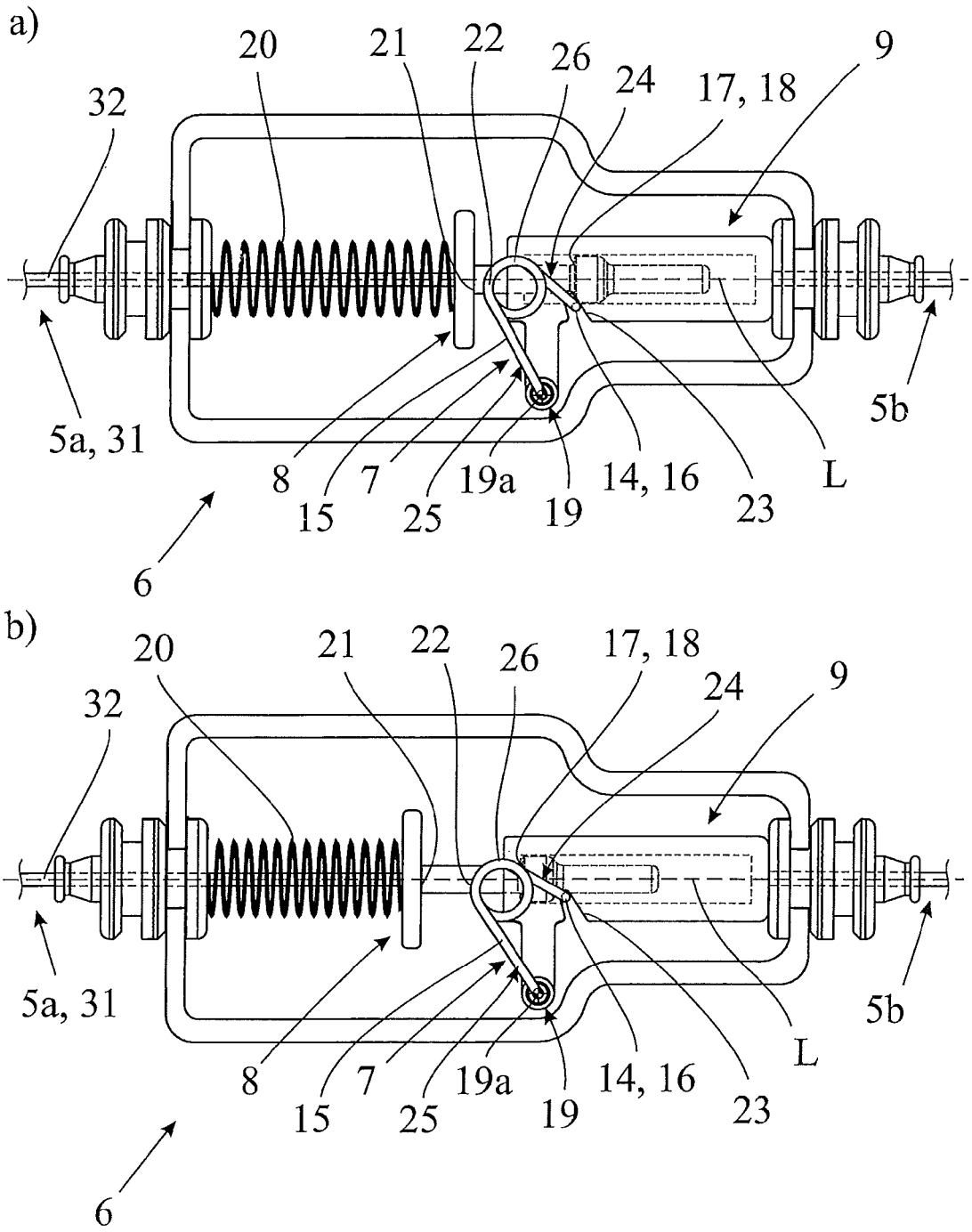

In the embodiment shown in FIGS. 3 to 5, the above noted principle is realized as follows:

During actuation, namely during the inertia movement section, the engagement section 17 of the first link element 8 moves along the longitudinal extension of movement L, while the actuation section 21 of the first link element 8 releases the actuation section 22 of the coupling spring element 7, such that the coupling spring element 7 moves, driven by its spring bias, into the catch position. Significant now is whether the coupling spring element 7 moves into the catch position in a timely manner such that it may come into coupling engagement with the engagement section 17 of the first link element 8.

In the case of a crash induced actuation, namely when the actuation movement surpasses the rapidity threshold, due to the inertial characteristic of the coupling spring element 7, the engagement section 17 of the first link element 8 bypasses the engagement section 16 of the coupling spring element 7, before the coupling spring element 7 reaches its catch position, such that the coupling spring element 7 enters its decoupling state. This corresponds to the sequence of FIGS. 3, 5*a*) and 5*b*).

During normal actuation, namely when the actuation movement is below the rapidity threshold, the engagement section 16 of the coupling spring element 7 reaches its catch position before the engagement section 17 of the first link element 8 bypasses the engagement section 16 of the coupling spring element 7, such that the coupling spring element 7 enters its coupling state. This corresponds to the sequence of FIGS. 3, 4*a*) and 4*b*).

It is to be pointed out that the above noted reset spring 20 guarantees the return of the crash coupling arrangement 6 into the initial state shown in FIG. 3, independent which state the coupling spring element 7 has reached before. This means that the proposed crash coupling arrangement 6 guarantees full functionality even after a crash situation has occurred.

Another advantage of the above noted reset spring 20 is the fact, that the reset spring 20 may serve for resetting the door handle 3 attached to the force transmission chain section 5*a*. With this, the construction of the door handle 3 may be simplified as well.

In order to have the reset spring 20 drive the coupling spring element 7 into the freewheel position, a part of the coupling spring element 7, such as the first output section 14 of the coupling spring element 7, is guided in a guide contour 23, wherein the reset spring 20, in the non-actuated state of the force transmission chain 5, drives this part of the coupling spring element 7, namely the first output section 14, along the guide contour 23. While the driving force of the reset spring 20 is basically aligned along the longitudinal extension of movement L, the first output section 14 of the coupling spring element 7 is moved into a direction, which at least includes a component perpendicular to the longitudinal extension of movement L. Accordingly the guide contour 23 redirects the driving force of the reset spring 20 from a direction along the longitudinal extension of movement L into a direction perpendicular to the longitudinal extension of movement L.

Accordingly the guide contour 23 is slanted with respect to the longitudinal extension of movement L such that, in the non-actuated state of the force transmission chain 5, driving the coupling spring element 7 along the guide contour 23 by the spring bias of the reset spring leads to driving the coupling spring element 7 into its freewheel position. The transmission of forces may easily be adjusted by an according adjustment of the slanting angle.

There are numerous possibilities for the realization of the coupling spring element 7. As shown in the drawings, the coupling spring element 7 is at least partly or fully, made of an elastically bendable wire. Alternatively, the coupling spring element 7 may also be realized at least partly or fully, made of an elastically bendable strip. A cost effective and at the same time robust design may be achieved by making the coupling spring element 7 at least partly or fully of spring steel. In the shown embodiments the coupling spring element 7 is fully made of a spring wire.

As shown in the drawings the engagement section 16 of the coupling spring element 7 is provided by the spring wire as such. In the case that the coupling element 7 is made of an elastically bendable strip, the engagement section 16 of the coupling spring element 7 may as well be provided by a strip section.

The cross-sectional design of the wire or strip, which the coupling spring element 7 is made of, may be realized in various ways. The spring wire may have a round, rectangular, square or the like cross-sectional shape. The same is to be noted for the strip section, wherein the strip section is optionally of rectangular cross-sectional shape.

The coupling spring element 7 is a one part component. In some cases, though, it may be advantageous that the coupling spring element 7 is a two or more component part.

Depending on the construction of the crash coupling arrangement 6 different shapes of the coupling spring element 7 are possible. The coupling spring element 7 is a leg spring with two legs, wherein one leg 24 provides the first output section 14 and wherein the other leg 25 provides the second output section 15. Further, the coupling spring element 7 includes a spring coil 26 between the two legs 24, 25, wherein the spring coil 26 optionally provides the actuation section 22 of the coupling spring element 7 as noted above.

It may be noted that for the understanding of the proposed solution the expression "leg spring" is to be understood in a broad sense. This broad interpretation includes leg springs with very short legs. The legs of the leg spring may be arranged axially, tangentially, or radially, in each case with respect to a geometrical axis of the spring coil.

Also the first link element 8 may be constructed in various ways. The first link element 8 includes the actuation section 21 and the engagement section 17 connected to it, wherein, the actuation section 21 and/or the engagement section 17 is/are rotationally symmetrical with respect to the longitudinal extension of movement L. While the actuation section 21 of the first link element 8 is designed as a round plate, the actuation section 21 of the first link element 8 is in this case provided as a thickening, which represents the above noted, ring-like abutment 18. The first link element 8 is can be a one piece component, as may be seen from the partly exploded view in FIG. 3. In this case it is made of a metal material, such as from Zamak material, in order to withstand the usual actuation forces.

The second link element 9 is optionally a tube like element, which receives at least part of the first link element 8, such as, for example, at least part of the engagement section 17 of the first link element 8. With this construction, the second link element 9 provides a first longitudinal guide for the first link element 8, which guarantees a high operational safety of the crash coupling arrangement 6. It is sometimes made of a metal material, and in some cases from Zamak material, in order to withstand the usual actuation forces.

Figure 6:
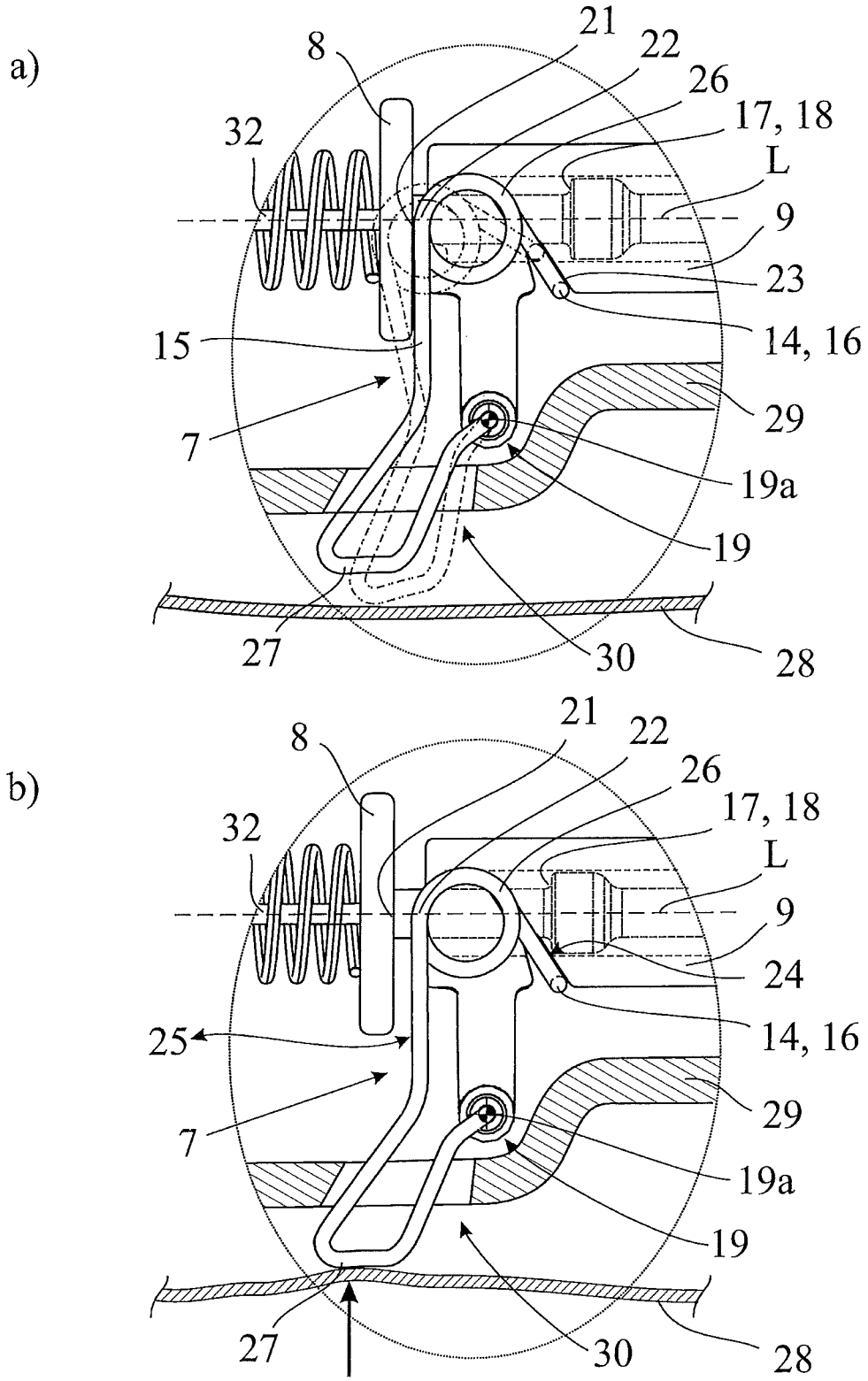

FIG. 6 shows a second embodiment of the crash coupling arrangement 6 in a detail view. All components of this second embodiment, that are not shown in FIG. 6, are identical to the respective components shown in FIGS. 3 to 5. As far as the rapidity dependent function of the crash coupling arrangement 6 is concerned, the function of the crash coupling arrangement 6 shown in FIG. 6 is identical to the function of the crash coupling arrangement 6 shown in FIGS. 3 to 5.

Interesting with regard to the second embodiment shown in FIG. 6 is the fact that the coupling spring element 7 includes an impact section 27, which in the installed state, due to crash induced deformation of a part of the motor vehicle, in particular of a body part 28 of the motor vehicle, may be driven by the deformed part 28, thereby driving the coupling spring element 7 into its freewheel position. As may be seen in FIG. 6, the impact section 27 is realized as an additional section formed into the coupling spring element 7. The mechanism of driving the coupling spring element 7 into its freewheel position is identical to the mechanism of the reset spring 20 driving the coupling spring element 7 into its freewheel position.

Particularly interesting regarding the second embodiment shown in FIG. 6 is the fact that the housing 29 of the crash coupling arrangement 6 includes a cut-out 30 through which the impact section 27 extends. In this way it is possible for the body part 28 to come into engagement with the impact section 27, when a deformation of the body part 28 occurs.

The crash coupling arrangement 6 is optionally provided separately from the motor vehicle lock 2, such that it may be attached to the motor vehicle lock 2 as noted above. In addition, the force transmission chain section 5*a* in this example is provided separately from the motor vehicle lock 2 as well. This separate force transmission chain 5*a* is advantageously connected to a door handle 3.

It may be pointed out that it is possible that both force transmission chain sections 5*a*, 5*b* are part of the motor vehicle lock 2. This is also applicable for the crash coupling arrangement 6, which may be integrated into the motor vehicle lock 2 as well. In such cases an additional force transmission chain has to be realized, which provides a driving connection between the door handle 3 and the motor vehicle lock 2.

On the other hand, it can also be the case that both force transmission chain sections 5*a*, 5*b* are provided separately from the motor vehicle lock 2. Again, this may well be applicable for the crash coupling arrangement 6, which, when realized separately from the motor vehicle lock 2, allows to flexibly provide or not provide an existing motor vehicle lock 2 with a crash coupling arrangement 6.

It may be pointed out, that at least part of the force transmission chain 5 and/or part of the crash coupling arrangement 6 may be part of a door handle 3, in particular an outer door handle 3 of the motor vehicle lock arrangement 1.

An especially cost effective and compact structure may be achieved if at least one force transmission chain section 5*a*, 5*b* includes a Bowden arrangement 31 with a Bowden cable 32 and a Bowden sheath 33, which surrounds the Bowden cable 32. The Bowden cable 32 runs in a well known manner within and along the Bowden sheath 33, in particular along the longitudinal extension of movement L.

According to another teaching, the above noted crash coupling arrangement 6 as such, which includes a coupling element in the form of a coupling spring element 7, is claimed. All explanations given for the proposed motor vehicle door lock arrangement 1 are fully applicable to this second teaching.

According to another teaching a crash coupling arrangement 6 as such is claimed, which provides at least one of the above noted link elements 8, 9 with an at least partly symmetric design as noted above as well. The realization of the coupling element as a coupling spring element 7 is not necessarily provided for this third teaching. Taking this into account, all explanations given for the proposed motor vehicle door lock arrangement 1 are applicable to this third teaching as well.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element in the form of a coupling spring element, wherein the coupling spring element can be brought into a coupling state, coupling the two force transmission chain sections, and into a decoupling state, decoupling the two force transmission chain sections, wherein the crash coupling arrangement comprises a first link element assigned to one force transmission chain section and a second link element assigned to the other force transmission chain section, wherein, the link elements are moveable along a longitudinal extension of movement, wherein the coupling spring element for coupling the two force transmission chain sections may come into coupling engagement with at least one of the link elements, wherein an inertial characteristic of the coupling spring element causes the coupling spring element to fall into or to remain in the decoupling state, when the actuation movement surpasses a rapidity threshold, and causes the coupling spring element to fall into or to remain in the coupling state, when the actuation movement is below the rapidity threshold, wherein at least one of the link elements, in the area of interaction with the coupling spring element, is at least partly symmetric with respect to the longitudinal extension of movement, such that rotation of this link element against the rest of the crash coupling arrangement around the longitudinal extension of movement does not affect its interaction with the coupling spring element.

2. The motor vehicle door lock arrangement according to claim 1, wherein the motor vehicle lock comprises a catch and a pawl, which is assigned to the catch, wherein the catch can be brought into an opening position and into a closed position, wherein the catch, which is in the closed position, is or may be brought into holding engagement with a lock striker, wherein the pawl may be brought into an engagement position, in which it is in blocking engagement with the catch, wherein for opening of the motor vehicle lock the pawl may be deflected into a release position, in which it releases the catch.

3. The motor vehicle door lock arrangement according to claim 1, wherein the coupling spring element may be brought into a catch position, in which the coupling spring element is arranged within the movement area of the first link element, and wherein the coupling spring element may be brought into a freewheel position, in which the coupling spring element is arranged outside the movement area of the first link element.

4. The motor vehicle door lock arrangement according to claim 1, wherein the coupling spring element comprises a first output section and a second output section, wherein the spring bias of the coupling spring element acts between the first output section and the second output section and wherein the first output section of the coupling spring element comprises an engagement section for the coupling engagement with an engagement section of the first link element.

5. The motor vehicle door lock arrangement according to claim 4, wherein the second output section is connected to the second link element, such that a coupling engagement between the first output section and the first link element leads to coupling of the two link elements and thereby coupling of the two force transmission chain sections.

6. The motor vehicle door lock arrangement according to claim 4, wherein, during actuation, the engagement section of the first link element moves along the longitudinal extension of movement and an actuation section of the first link element releases the actuation section of the coupling spring element, such that the coupling spring element moves, driven by its spring bias, into the catch position.

7. The motor vehicle door lock arrangement according to claim 4, wherein, during actuation, when the actuation movement surpasses the rapidity threshold, due to the inertial characteristic of the coupling spring element, the engagement section of the first link element bypasses an engagement section of the coupling spring element, before the coupling spring element reaches its catch position, such that the coupling spring element enters its decoupling state.

8. The motor vehicle door lock arrangement according to claim 4, wherein, during actuation, when the actuation movement is below the rapidity threshold, the engagement section of the coupling spring element reaches its catch position before the engagement section of the first link element bypasses an engagement section of the coupling spring element, such that the coupling spring element enters its coupling state.

9. The motor vehicle door lock arrangement according to claim 4, wherein a part of the coupling spring element, in particular the first output section of the coupling spring element, is guided in a guide contour and that a reset spring, in the non-actuated state, drives said part of the coupling spring element along the guide contour.

10. The motor vehicle door lock arrangement according to claim 9, wherein the guide contour is slanted with respect to the longitudinal extension of movement such that, in the non-actuated state, driving the coupling spring element along the guide contour by the spring bias of the reset spring leads to driving the coupling spring element into its freewheel position.

11. The motor vehicle door lock arrangement according to claim 4, wherein the coupling spring element is a leg spring with two legs, wherein one leg provides the first output section and wherein the other leg provides the second output section.

12. The motor vehicle door lock arrangement according to claim 4, wherein the first link element comprises the actuation section and the engagement section connected to it, wherein, the actuation section and/or the engagement section is/are rotationally symmetrical with respect to the longitudinal extension of movement.

13. The motor vehicle door lock arrangement according to claim 4, wherein the second link element is a tube like element, which receives at least part of the first link element, in particular at least part of the engagement section of the first link element.

14. The motor vehicle door lock arrangement according to claim 1, wherein the spring bias of the coupling spring element urges the coupling spring element into its catch position.

15. The motor vehicle door lock arrangement according to claim 1, wherein the coupling spring element is at least partly made of an elastically bendable wire or strip.

16. The motor vehicle door lock arrangement according to claim 1, wherein the coupling spring element comprises an impact section, which in the installed state, due to a crash induced deformation of a part of a motor vehicle, in particular of a body part of the motor vehicle, may be driven by the deformed part, thereby driving the coupling spring element into its freewheel position.

17. The motor vehicle door lock arrangement according to claim 1, wherein the crash coupling arrangement is provided separately from the motor vehicle lock, and/or, wherein at least one force transmission chain section is provided separately from the motor vehicle lock.

18. The motor vehicle door lock arrangement according to claim 1, wherein at least one force transmission chain section comprises a Bowden arrangement with a Bowden cable and a Bowden sheath.

19. A crash coupling arrangement for the insertion between two sections of a force transmission chain for a motor vehicle lock, wherein in the installed state an actuation movement may be transmitted via the force transmission chain for opening of the motor vehicle lock, wherein the crash coupling arrangement comprises a coupling element, wherein the crash coupling arrangement comprises a first link element assigned to one of the two sections of the force transmission chain and a second link element assigned to the other force transmission chain section of the two sections of the force transmission chain, wherein the link elements are moveable along a longitudinal extension of movement, wherein the coupling element for coupling the two force transmission chain sections may come into coupling engagement with at least one of the link elements, wherein an inertial characteristic of the coupling element causes the coupling element to fall into or to remain in the decoupling state, when the actuation movement surpasses a rapidity threshold, and causes the coupling element to fall into or to remain in the coupling state, when the actuation movement is below the rapidity threshold, wherein at least one of the link elements, in the area of interaction with the coupling element, is at least partly symmetric with respect to the longitudinal extension of movement, such that rotation of this link element against the rest of the crash coupling arrangement around the longitudinal extension of movement does not affect its interaction with the coupling spring element.

20. A motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element in the form of a coupling spring element, wherein the coupling spring element can be brought into a coupling state, coupling the two force transmission chain sections, and into a decoupling state, decoupling the two force transmission chain sections, wherein the crash coupling arrangement comprises a first link element assigned to one force transmission chain section and a second link element assigned to the other force transmission chain section, wherein, the link elements are moveable along a longitudinal extension of movement, wherein the coupling spring element for coupling the two force transmission chain sections may come into coupling engagement with at least one of the link elements, wherein an inertial characteristic of the coupling spring element causes the coupling spring element to fall into or to remain in the decoupling state, when the actuation movement surpasses a rapidity threshold, and causes the coupling spring element to fall into or to remain in the coupling state, when the actuation movement is below the rapidity threshold, and wherein the first link element is spring biased by a reset spring, which reset spring, in the non-actuated state, drives an actuation section of the first link element into engagement with an actuation section of the coupling spring element, thereby driving the coupling spring element into its freewheel position against the spring bias of the coupling spring element.

21. A motor vehicle door lock arrangement with a motor vehicle lock, wherein a force transmission chain is provided and wherein an actuation movement may be transmitted via the force transmission chain for opening of the motor vehicle lock, wherein a crash coupling arrangement is provided between two force transmission chain sections, which comprises a coupling element in the form of a coupling spring element, wherein the coupling spring element can be brought into a coupling state, coupling the two force transmission chain sections, and into a decoupling state, decoupling the two force transmission chain sections, wherein the crash coupling arrangement comprises a first link element assigned to one force transmission chain section and a second link element assigned to the other force transmission chain section, wherein, the link elements are moveable along a longitudinal extension of movement, wherein the coupling spring element for coupling the two force transmission chain sections may come into coupling engagement with at least one of the link elements, wherein an inertial characteristic of the coupling spring element causes the coupling spring element to fall into or to remain in the decoupling state, when the actuation movement surpasses a rapidity threshold, and causes the coupling spring element to fall into or to remain in the coupling state, when the actuation movement is below the rapidity threshold, and wherein the coupling spring element is completely made of an elastically bendable wire or strip.

* * * * *